United States Patent [19]

Kondo

[11] Patent Number: 4,573,812

[45] Date of Patent: Mar. 4, 1986

[54] INTERCHARACTER SPACE PROCESSING APPARATUS FOR PRINTERS

[75] Inventor: Yoshihisa Kondo, Iwate, Japan

[73] Assignee: Alps Electric Co., Ltd., Japan

[21] Appl. No.: 655,938

[22] Filed: Sep. 28, 1984

[30] Foreign Application Priority Data

Sep. 29, 1983 [JP] Japan ..... 58-181504

[51] Int. Cl.[4] ..... B41J 19/32

[52] U.S. Cl. ..... 400/121; 400/303

[58] Field of Search ..... 400/3, 9, 12, 303, 305, 400/306, 64, 121

[56] References Cited

U.S. PATENT DOCUMENTS

| | | | |
|---|---|---|---|
| 3,185,823 | 5/1965 | Ellersick et al. | 364/900 X |
| 3,973,487 | 10/1976 | Mahoney | 101/93.29 |
| 4,298,290 | 11/1981 | Barnes et al. | 400/3 |
| 4,371,274 | 2/1983 | Jaeger | 400/303 X |
| 4,462,701 | 7/1984 | Czyszczewski | 400/64 X |

FOREIGN PATENT DOCUMENTS

| | | | |
|---|---|---|---|
| 120379 | 9/1981 | Japan | 400/3 |

OTHER PUBLICATIONS

*IBM Tech. Disc. Bulletin*, by R. A. Pasco, vol. 25, No. 4, Sep. 1982, pp. 2166–2167.

*Primary Examiner*—Paul T. Sewell
*Attorney, Agent, or Firm*—Guy W. Shoup

[57] ABSTRACT

An intercharacter space processing apparatus for use in a printer, comprises a receiver for receiving a print signal, a memory for storing character codes received by the receiver, a dot space control unit responsive to an intercharacter dot space signal received by the receiver for inserting a prescribed dot space signal between the character codes stored in the memory, so that the printer will print characters on a print surface based on information stored in the memory, first means for producing a signal when a dot space area on the print surface according to the dot space signal inserted by the dot space control unit exceeds a dot space area represented by a space code given by the print signal, and second means responsive to the signal from the first means for converting the dot space signal into the code and storing the space code into the memory.

2 Claims, 8 Drawing Figures

INTERCHARACTER SPACE PROCESSING APPARATUS FOR PRINTERS

BACKGROUND OF THE INVENTION

The present invention relates to an intercharacter space processing apparatus for use in printers, and more particularly to such an intercharacter space processing apparatus for converting an intercharacter space (an extra space left blank) between characters to be printed by the printer into a space code (SPC) of print control codes for processing when such an intercharacter space exceeds a predetermined value.

It frequently occurs that the entire length of a line of characters and symbols to be printed by a printer is short of a predetermined line length. If a line to be printed is shorter than such a predetermined line length by the half width of a character, then the spaces between the characters in the line are slightly adjusted to give the line the desired line length, so that the line can be printed with a printlike appearance, or stated otherwise, the right margin can be justified.

For storing data on small intercharacter spaces, it has been conventional practice to store the value of a multiple of a minimum feed length to be inserted between characters in one line as a dot space or a dot pattern, and to read out the stored value for generating a space. As long as the number of dot spaces to be inserted between characters is small, no large storage capacity is required even when they are stored in the form of dot patterns. However, when it is necessary to store dot spaces corresponding to a few characters, a large storage capacity is needed for storing the dot spaces, and a storage area must be provided for each of the characters. It would be possible to provide a storage area of a variable length as desired when the dot spaces are generated. This would result in a complex control mode since a control signal indicative of a special variable length would have to be received and whether the storage area is of a variable length would have to be determined.

SUMMARY OF THE INVENTION

With the conventional problems in view, it is an object of the present invention to provide an intercharacter space processing apparatus of a simple arrangement for automatically converting the width of dot spaces between characters to be printed by a printer into a space code (SPC) when the dot space width exceeds a dot space width generated by a space code (SPC) of print control codes, and to store the space code, thereby reducing a storage capacity required for storing the dot spaces.

According to the present invention, there is provided an intercharacter space processing apparatus for use in a printer, comprising a receiver for receiving a print signal, a memory for storing character codes received by the receiver, a dot space control unit responsive to an intercharacter dot space signal received by the receiver for inserting a prescribed dot space signal between the character codes stored in the memory, so that the printer will print characters on a print surface based on information stored in the memory, first means for producing a signal when a dot space area on the print surface according to the dot space signal inserted by the dot space control unit exceeds a dot space area represented by a space code given by the print signal, and second means responsive to the signal from the first means for converting the dot space signal into the space code and storing the space code into the memory.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIGS. (1(A) through (1(C) illustrate characters printed by a dot printer.

FIS. 2(A) through 2(C) are diagrams explanatory of dot space storage according to an intercharacter space processing apparatus according to the present invention.

DETAILED DESCRIPTION

Figure 4:
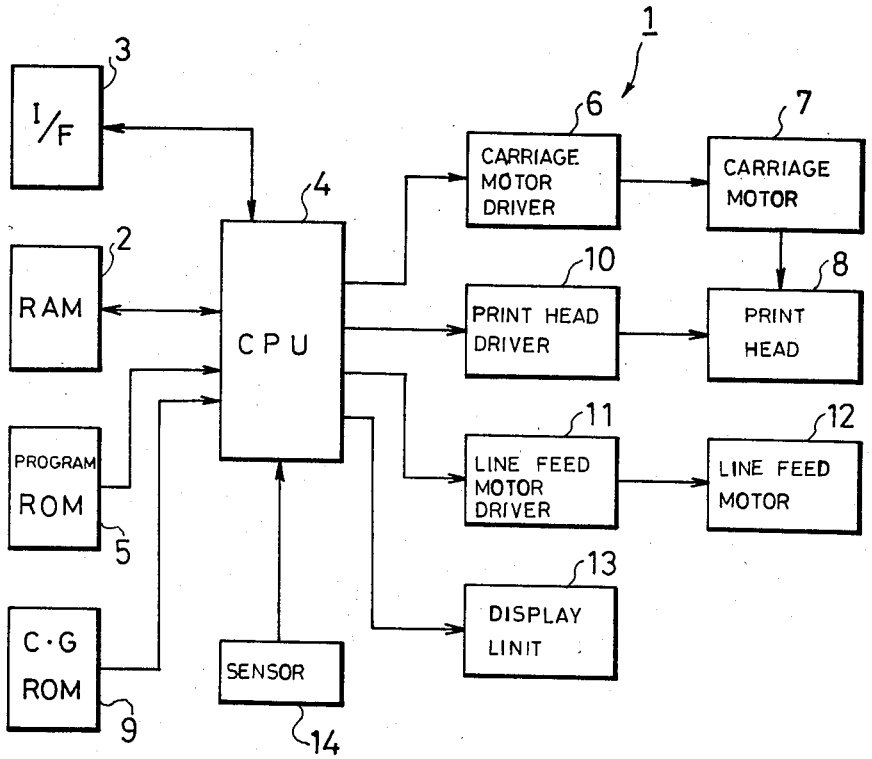
FIG. 4 is a block diagram of a printer incorporating the intercharacter space processing apparatus of the present invention.

FIG. 4 shows in a block form a printer in which an intercharacter space processing apparatus according to the present invention is incorporated. The printer, generally designated at 1, is composed of a random-access memory (RAM) 2, an interface (I/F) 3, a central processing unit (CPU) 4, a read-only memory (ROM) 5 for storing a program, a carriage motor driver 6, a carriage motor 7, a print head 8, a character generator read-only memory (C.G. ROM) 9, a print head driver 10, a line feed motor driver 11, a line feed motor 12, a display unit 3, and a sensor 4.

Figure 1A:
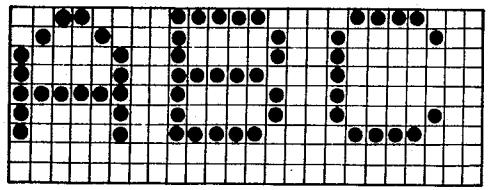
Figure 1B:
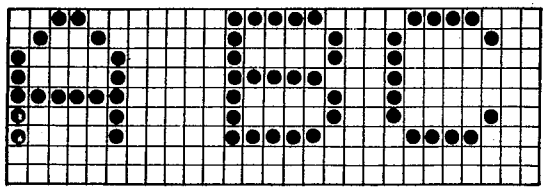
Figure 1C:
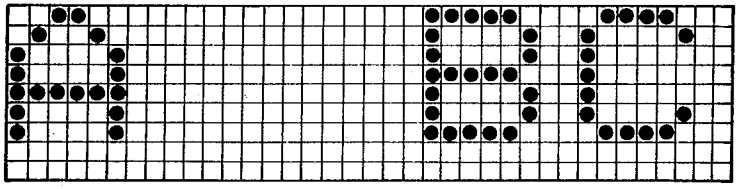

FIG. 1(A) shows characters printed when there are no dot space commands between character codes. FIG. 1(B) illustrates characters printed when there is a dot space command "3" indicative of a space smaller than one character between character codes "A" and "B". FIG. 1(C) shows characters printed when there is a dot space command "13" indicative of a space larger than one character between character codes "A" and "B".

It has conventionally been practiced to insert a desired blank area (called a "dot space") between characters as illustrated in FIG. 1(B) of 1(C) for arranging the characters for a slightly printout. For printing the illustrated characters the printer is supplied from a host computer with character codes representing the characters to be printed, and a shape of dots or a dot pattern representing the dot space. Therefore, the printer must be provided with storage areas as large as a maximum number of dots, "13" for example as shown in FIG. 1(C) between the characters for storing a dot space command issued from the host computer. If a space area that can freely be established between the characters could be of a large size, then a storage area commensurate with the maximum dot space (which is expressed by a binary notation and stored) would have to be provided, resulting in an increased storage capaacity required. If no space areas to be inserted between characters having a size equal to or greater than the width of one character were provided, that is, if only space areas having a size equal to or smaller than the width of the dot space were provided, then the printer would become inconvenient in use or would have a limited editing capability.

According to the present invention, when a dot space between character codes which is generated by a dot space command from the host computer exceeds a dot space number generated on the basis of a "space code" which is a print control signal, that is, when characters as shown in FIG. 1 (C) for example, are to be printed, the printer automatically converts the dot space into a "space code" signal and stores the same without waiting for a command from the host computer, and stores the remaining dot space as a dot space number for printing operation. With such an arrangement, the value of a binary number to be written in a storage area to generate a dot space between characters is a dot space number or smaller which is generated on the basis of a "space code", for example, 8 (expessed in 3 bits according to the binary notation) or smaller in the example of FIG. 1. Accordingly, the storage capacity required can be reduced, and the width of a space area that can be provided between characters is not undesirably limited.

Figure 2A:
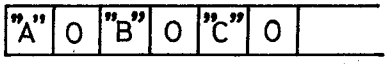

FIG. 2(A) illustrates dot spaces stored for the character train shown in FIG. 1(A) according to the present invention. "A", "B", and "C" are representative of character codes, and the numerals "0" between the character codes indicate that dot spaces are zero.

Figure 2B:
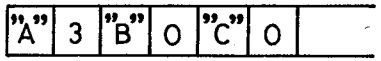

FIG. 2(B) shows dot spaces stored for the character train shown in FIG. 1(B). The dot space between the character codes "A" and "B" is "3".

Figure 2C:
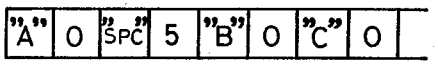

FIG. 2(C) shows dot spaces stored for the character train shown in FIG. 1(C). The dot space between the character codes "A" and "B" is "13" which is greater than the dot space number ("8" in the example of FIG. 1) corresponding to the "space code" which is a print control signal. Conventionally, the numeral "13" is simply stored between the character codes "A" and "B". According to the embodiment of the present invention, in order to reduce the storage capacity and remove any substantial limitation on the dot space number, a "space code" which is a print control signal is automatically given for each 8-dot space inserted. More specifically, the 13-dot space between the character codes "A" and "B" is converted in a 1 space code and a 5-dot space, which are stored as illustrated in FIG. 1(C). As a consequence, any binary number indicative of the width of a dot space is 8 or smaller according to the present embodiment.

Figure 3:
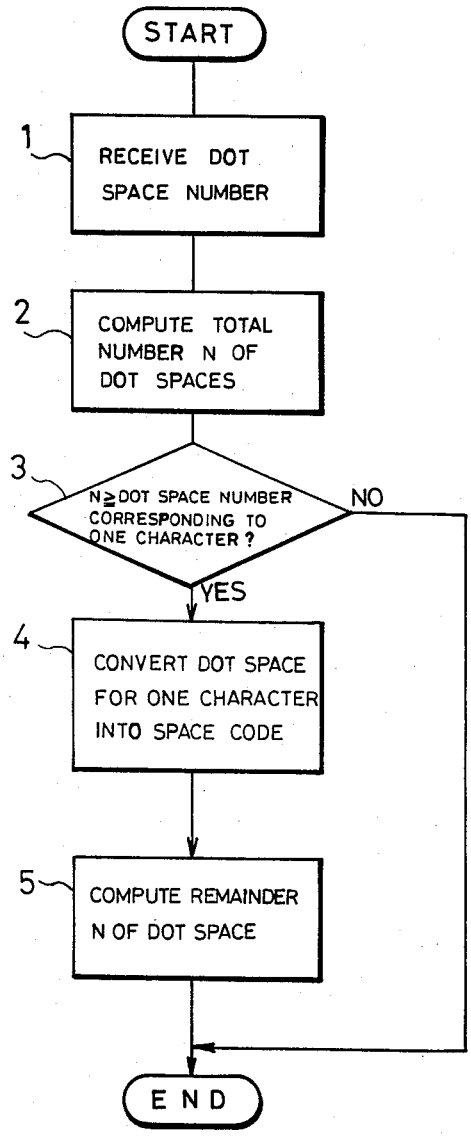
FIG. 3 is a flowchart of operation of the intercharacter space processing apparatus according to the present invention.

FIG. 3 shows a flowchart of operation of the intercharacter space processing apparatus of the invention. The illustrated flowchart is illustrative of steps of operation for storing the character codes and dot space as shown in FIG. 2(C) when data on the character train as illustrated in FIG. 1(C) are supplied from the host computer to the printer according to the present invention.

The flowchart includes a step 1 for receiving a dot space number. In the step 1, the printer receives a command for providing a given dot space between characters from the host computer.

A step 2 computes the total number N of dot spaces. More specifically, since there may have already been dot spaces between characters, the step 2 computes the total number N of dot spaces between characters in addition to a currently given dot space command.

Then, the program goes to a step 3 for determining whether the total number N of dot spaces is greater than a dot space number corresponding to one character. If the answer is YES, then the program proceeds to a next step 4, and if NO, the program goes to END as the dot space number is smaller than a dot space number corresponding to a space code (SPC) given.

The step 4 converts the dot space corresponding to one character into the "space code (SPC)" which is then stored in the storage area as shown in FIG. 2(C). After one "space code (SPC)" has been stored, and if the total number N of remaining dot spaces is greater than the dot space number corresponding to one character, then the above conversion process is repeated. Each time the dot space is converted into the space code, the dot space number "0" is stored between the character code "A" and the space code "SPC" as shown in FIG. 2(C). This process causes the total number N of any remaining dot spaces to be always smaller than the dot space corresponding to the space code.

A next succeeding step 5 computes the remainder N of dot spaces, and stores the remainder N in a storage area between the space code "SPC" and the character code "B", for example, as shown in FIG. 2(C).

The RAM 2 shown in FIG. 4 serves to store the dot space number as described above.

When a print request is fed from the host computer to the CPU 4 through the I/F 3 in the printer of the present invention, the CPU 4 temporarily stores character codes to be printed and other data into an assigned area in the RAM 2. When a command for providing a prescribed number of dot spaces between characters is given by the host computer to the CPU 4 through the I/F 3, the CPU 4 processes the character codes, space code (SPC) or dot space number as stored in the assigned area in the RAM 2 as shown in FIGS. 2(A), (B) and (C) based on processing commands stored in the program ROM 5.

When one line is to be printed under a print command from the host computer after character codes to be printed for one line have been stored in the RAM 2, the CPU 4 supplies a drive signal through the carriage motor driver 6 to the carriage motor 7 to move the print head 8 mounted on the carriage at a constant speed, reads the character codes to be printed out of the assigned area in the RAM 2, and picks up character patterns corresponding to the character codes thus read from the C.G. ROM 9 to drive print pins on the print head 8 through the print head driver 10 in synchronism with the movement of the carriage, for thereby printing the characters.

After one line has been printed, the CPU 4 drives the line feed motor 12 through the line feed motor driver 11 to advance the sheet of print paper a predetermined length. Printing conditions are displayed on the display unit 13. The sensor 14 comprises a switch for determining a start position such for example as a home position of the carriage motor.

With the arrangement of the present invention, as described above, when a dot space, given by the host computer, between characters to be printed by the printer exceeds a dot space corresponding to a space code (SPC) of print control codes, the dot space is automatically converted into the space code (SPC) without waiting for a command from the host computer, and the space code is stored for printing operation. Therefore, the storage area for storing the dot space information can be reduced.

Although a certain preferred embodiment has been shown and described, it should be understood that many changes and modifications may be made therein without departing from the scope of the appended claims.

What is claimed is:

1. An intercharacter space processing apparatus for use in a printer, comprising:

(a) a receiver for receiving print code signals;

(b) a memory for storing character codes received by said receiver;

(c) a dot space control unit responsive to an intercharacter dot space signal received by said receiver for inserting an intercharacter space code between character codes stored in said memory, so that the printer will print characters on a print surface based on information stored in said memory;

(d) first means for computing the total number of dot spaces of the intercharacter dot space area and producing a signal when the dot space area according to the intercharacter dot space signal is greater than a predetermined dot space area represented by a space character code; and (e) second means responsive to said signal from said first means for converting the intercharacter dot space area into an intercharacter space code comprising one or more space character codes and a remainder dot space area code, which is equal to the excess of the intercharacter dot space area over the space character area, and storing said code into said memory.

2. An intercharacter space processing apparatus according to claim 1, including a central processing unit programmed to perform the functions of said receiver, said dot space control unit, said first means, and said second means.

* * * * *